US008181616B2

(12) United States Patent
Sailer et al.

(10) Patent No.: US 8,181,616 B2
(45) Date of Patent: May 22, 2012

(54) ROLLER TAPPET FOR INTERNAL COMBUSTION PISTON ENGINES COMPRISING AN ANTI-ROTATION DEVICE

(75) Inventors: Peter Sailer, Erlangen (DE); Oliver Schnell, Veitsbronn (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 611 days.

(21) Appl. No.: 12/288,372

(22) Filed: Oct. 20, 2008

(65) Prior Publication Data

US 2009/0107427 A1 Apr. 30, 2009

(30) Foreign Application Priority Data

Oct. 26, 2007 (DE) ..... 10 2007 051 301

(51) Int. Cl.
*F01L 1/14* (2006.01)

(52) U.S. Cl. ..... 123/90.5; 123/90.48; 123/90.52

(58) Field of Classification Search ..... 123/90.5, 123/90.48, 90.52, 90.16
See application file for complete search history.

(56) References Cited

U.S. PATENT DOCUMENTS

| | | | | |
|---|---|---|---|---|
| 3,977,370 | A * | 8/1976 | Humphreys | 123/90.5 |
| 4,885,952 | A * | 12/1989 | Connell | 74/569 |
| 2003/0041820 | A1 * | 3/2003 | Faria et al. | 123/90.5 |
| 2005/0045132 | A1 * | 3/2005 | Hendriksma et al. | 123/90.48 |

* cited by examiner

*Primary Examiner* — Zelalem Eshete
(74) *Attorney, Agent, or Firm* — Volpe and Koenig, P.C.

(57) ABSTRACT

An internal combustion piston engine comprising at least one cylinder head, said cylinder head closing at least one cylinder, inlet and outlet channels of said cylinder head being regulated, each one, by at least one inlet and outlet valve that is loaded by a closing spring, said inlet and outlet valves being activated by roller tappets (1) driven by cams of a camshaft and, if appropriate, by further transmission elements, said roller tappets (1) comprising at ends oriented away from rollers (7) of the roller tappets, two flattened portions (2) that are arranged substantially parallel to each other while being operatively connected to two matching inner surfaces (9) of an anti-rotation bridge (10) made typically of plastic, a spacing dimension of said flattened portions (2) at least partially overlapping a distance between said inner surfaces (9) and, starting from a mounting position of the roller tappet (1) in the anti-rotation bridge (10), an adjustment between the flattened portions. (2) of the roller tappets (1) and the inner surfaces (9) of the anti-rotation bridge (10) is varied with a tendency to adjustment with lash in direction of an operating position of the roller tappet (1).

12 Claims, 4 Drawing Sheets

ROLLER TAPPET FOR INTERNAL COMBUSTION PISTON ENGINES COMPRISING AN ANTI-ROTATION DEVICE

FIELD OF THE INVENTION

An internal combustion piston engine comprising at least one cylinder head, said cylinder head closing at least one cylinder, inlet and outlet channels of said cylinder head being regulated, each one, by at least one inlet and outlet valve that is loaded by a closing spring, said inlet and outlet valves being activated by roller tappets driven by cams of a camshaft and, if appropriate, by further transmission elements, said roller tappets comprising at ends oriented away from rollers of the roller tappets, two flattened portions that are arranged substantially parallel to each other while being operatively connected to two matching inner surfaces of an anti-rotation bridge made typically of plastic, and a spacing dimension of said flattened portions at least partially overlapping a distance between said inner surfaces.

BACKGROUND OF THE INVENTION

A generic internal combustion piston engine known from U.S. Pat. No. 5,088,488 comprises roller tappets of the pre-cited type and an anti-rotation device in the form of an anti-rotation bridge of the pre-cited type. The anti-rotation bridge is made of a polymer material, e.g. polyamide, and is fixed to a component of the internal combustion piston engine.

For facilitating mounting of the roller tappets on the internal combustion piston engine, the spacing dimension of the flattened portions on the roller tappets is larger than the spacing dimension of the inner surfaces on the anti-rotation bridge, so that an overlap is created, i.e. the roller tappets are clamped in the anti-rotation bridge. This is useful and of advantage for the mounting of the roller tappets on the internal combustion piston engine but leads to undesired higher friction in the subsequent operation of the engine.

OBJECTS OF THE INVENTION

It is therefore an object of the invention to improve an internal combustion piston engine of the pre-cited type, and more specifically the cooperation between the roller tappets and the anti-rotation bridge, such that a reliable retention of the roller tappets on the anti-rotation bridge and, thus also, on the internal combustion piston engine, is guaranteed during mounting, but a reduction of friction between the roller tappets and the anti-rotation bridge during operation is achieved.

This and other objects and advantages of the invention will become more obvious from the following detailed description.

SUMMARY OF THE INVENTION

The invention achieves the above objects by the fact that, starting from a mounting position of the roller tappet in the anti-rotation bridge, an adjustment between the flattened portions of the roller tappets and the inner surfaces of the anti-rotation bridge is varied with a tendency to adjustment with lash in direction of an operating position of the roller tappet.

Advantageously, in an end region of the roller tappet oriented away from the roller, a spacing between the flattened portions is larger than in a region adjacent the roller.

As a result of this, when the roller tappets are pushed into the anti-rotation bridge for mounting, they are retained in the anti-rotation bridge by the region of partial overlap, and in the operating position of the roller tappets, the overlap is reduced to an extent that an adjustment with slight lash is obtained, so that friction during operation is substantially reduced.

In a so-called T-design of the roller tappets, the flattened portions of the roller tappets in the region adjacent the roller, which corresponds substantially to the operating region, are parallel to each other. Due to the fact that the T-shaped head of the roller tappets overlaps the inner surfaces of the anti-rotation bridge, a reliable retention of the roller tappets during mounting is assured.

In a V-shaped design according to an alternative solution, the flattened portions in the region adjacent the roller can be configured such that the spacing dimension of the flattened portion decreases in direction of the roller.

In still another embodiment, with an A-shaped design, the flattened portions in the region adjacent the roller can be configured such that the spacing dimension increases in direction of the roller.

A further reduction of friction between the roller tappets and the anti-rotation bridge is obtained by the fact that at least one opening is arranged in the region of the flattened portions, typically in the region of the roller tappet adjacent the roller, said opening being loaded on an inner side by oil from the internal combustion piston engine, typically pressure oil. Advantageously, the at least one opening is arranged in the region of the flattened portions adjacent the roller at ends adjacent the end region, i.e. in the upper region of the contact surfaces during the operation of the internal combustion piston engine. Advantageously, in this embodiment, a circumferential groove, which assures a reliable distribution of the supplied oil, is arranged in the roller tappets at an inner end of the at least one opening.

Relevant to the friction during the operation of the roller tappet is also the spacing dimension of the inner surfaces of the anti-rotation bridge. This dimension advantageously decreases in direction of the roller. This is also insofar favorable as the anti-rotation bridge is not made of a rigid plate but is formed with a profile, so that the walls of the inner surfaces are free-standing to a certain extent.

In a further development of the invention, it is proposed to configure the spacing dimension of the inner surfaces of the anti-rotation bridge in non-continuous and/or partially continuous reciprocal relationship to the spacing dimension of the flattened portions on the roller tappet. In other words, the inner surfaces of the anti-rotation bridge are matched to the associated dimensions of the flattened portions. This is also true for the region that is operatively connected to the end region of the flattened portions of the roller tappets. This results in a clear locking of the roller tappets in the mounted state and a low friction in the operative state.

To improve lubrication of the respective associated surfaces, oil grooves can be provided in the inner surfaces of the anti-rotation bridge.

Oil supply to the contact surfaces is particularly simplified if a hydraulic valve lash adjuster, which comprises at least one piston, a cylinder housing cooperating with the piston, a return spring with a one-way valve arranged between the piston and the housing, as also a pressure oil supply, is installed in each of the roller tappets. In this way, the pressure oil supply to the valve lash adjuster can be utilized for oil supply at least to the one opening in the region of the flattened portion adjacent to the roller.

BRIEF DESCRIPTION OF THE DRAWINGS

For a further explanation of the invention, reference is made to the drawings in which examples of embodiment of the invention are shown in simplified illustrations.

DETAILED DESCRIPTION OF THE DRAWINGS

Figure 1:
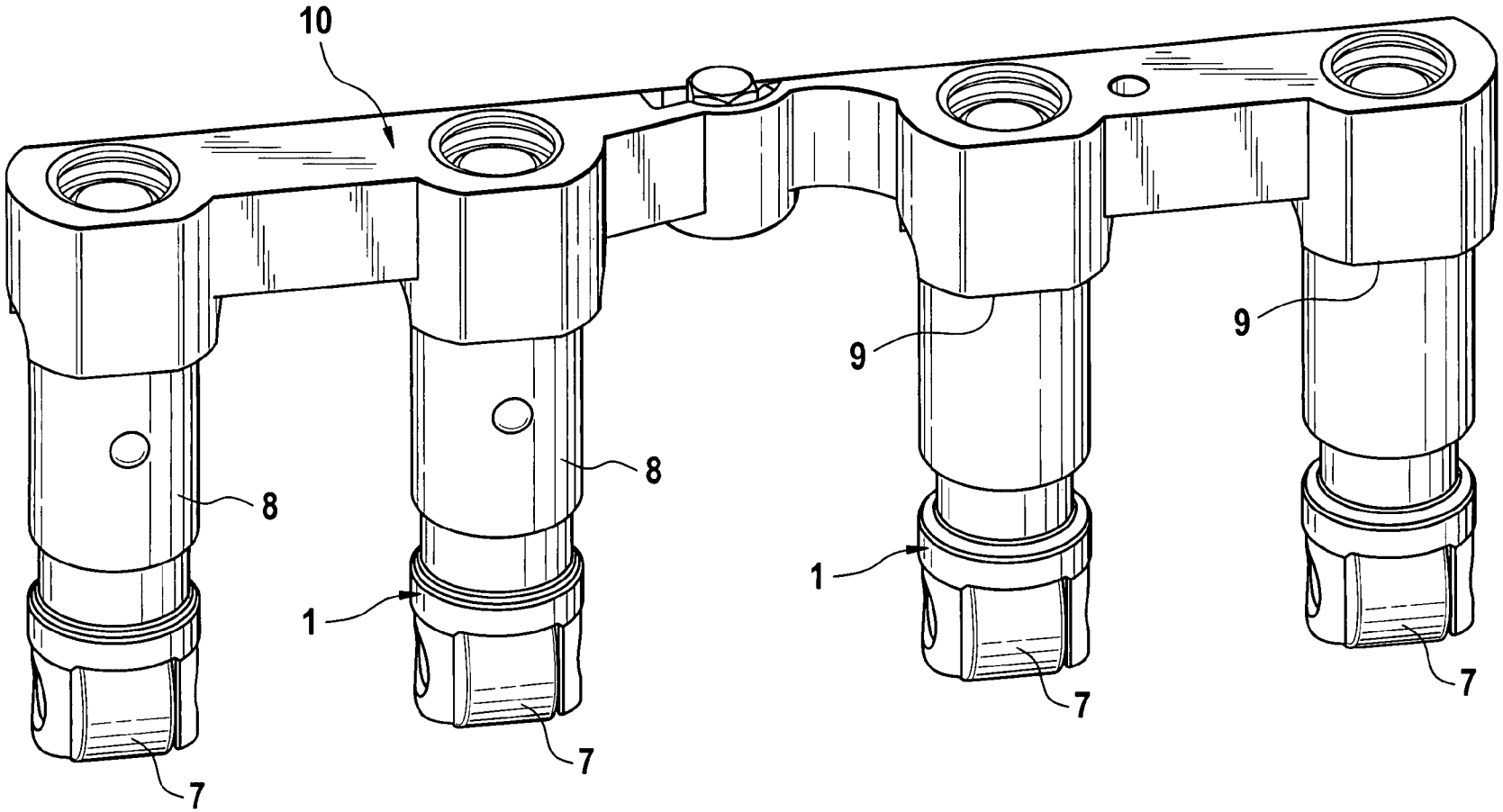
FIG. 1 is a perspective representation of an assembly comprising roller tappets and an anti-rotation bridge.

In FIGS. 1 to 6, where shown, a roller tappet is generally identified at 1, FIGS. 1 to 6 showing end regions of the tappets in partial sections. At their ends oriented towards a camshaft, not shown, the roller tappets 1 comprise rollers 7 that are guided through rolling bearings on the roller tappets 1. The roller tappets 1 further comprise flattened portions, identified at 2, that comprise an end region 3 oriented away from the roller 7 and a region 4 adjacent to the roller 7. The flattened portions 2 are guided in inner surfaces 9 that are constituent parts of an anti-rotation bridge 10. The roller tappets further comprise cylindrical guides 8 disposed between the rollers 7 and the flattened portions 2 through which the roller tappets are mounted, not shown, in a component of the internal combustion piston engine that is adjacent to the camshaft.

Figure 2:
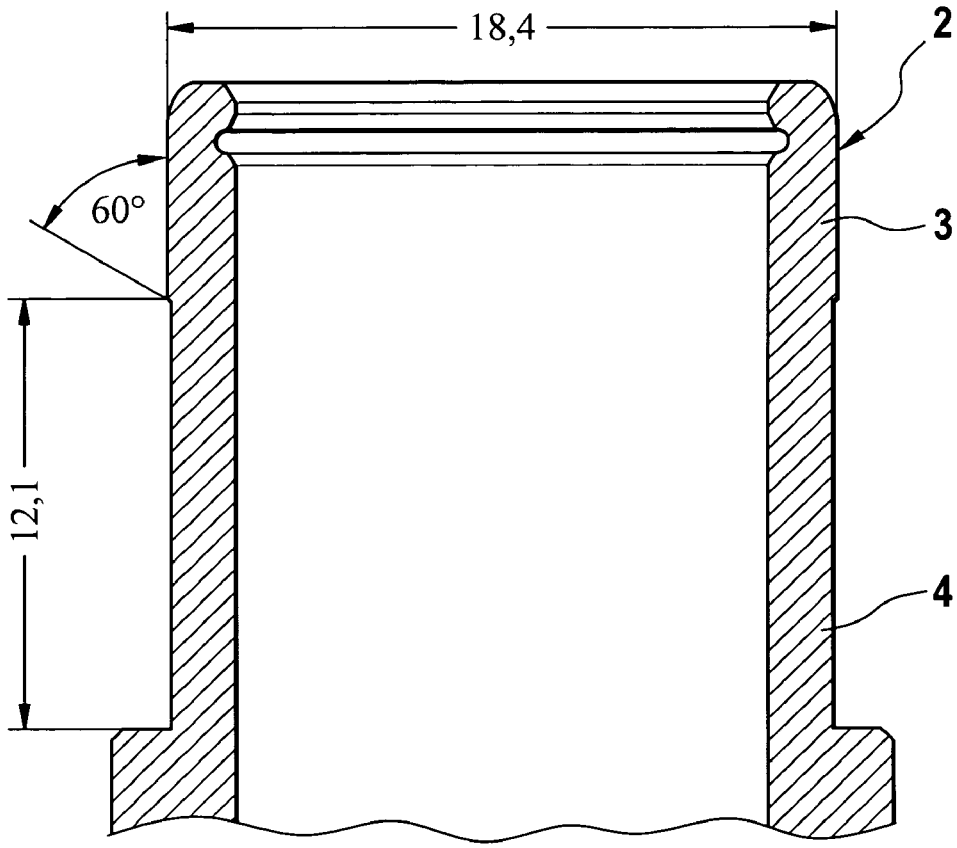
FIG. 2 shows a section through an end region of a roller tappet oriented away from the roller, on an enlarged scale.

In the example of embodiment of FIG. 2, the end region 3 has a dimension which leads to an overlap of the spacing dimension of the inner surfaces 9 of the anti-rotation bridge 10 and is configured with 18.4 mm.

This end region 3 merges with the region 4 that is adjacent to the roller 7 and whose flattened portions have a smaller dimension but are parallel to each other. The length of this region 4 adjacent the roller 7 is 12.1 mm and is configured with small steps relative to the end region 3. The examples of embodiment of FIGS. 3 and 4 again comprise end regions 3 that have a spacing dimension of 18.5 mm and, starting from the step shown in FIG. 3, the spacing dimension of the regions 4 which adjoin the roller 7 diminishes in the direction of the roller 7, so that, at first, this spacing dimension of the regions 4 is 18.4 mm and decreases to 18.05 mm till the end of the region 4 in the direction of the roller 7.

Figure 3:
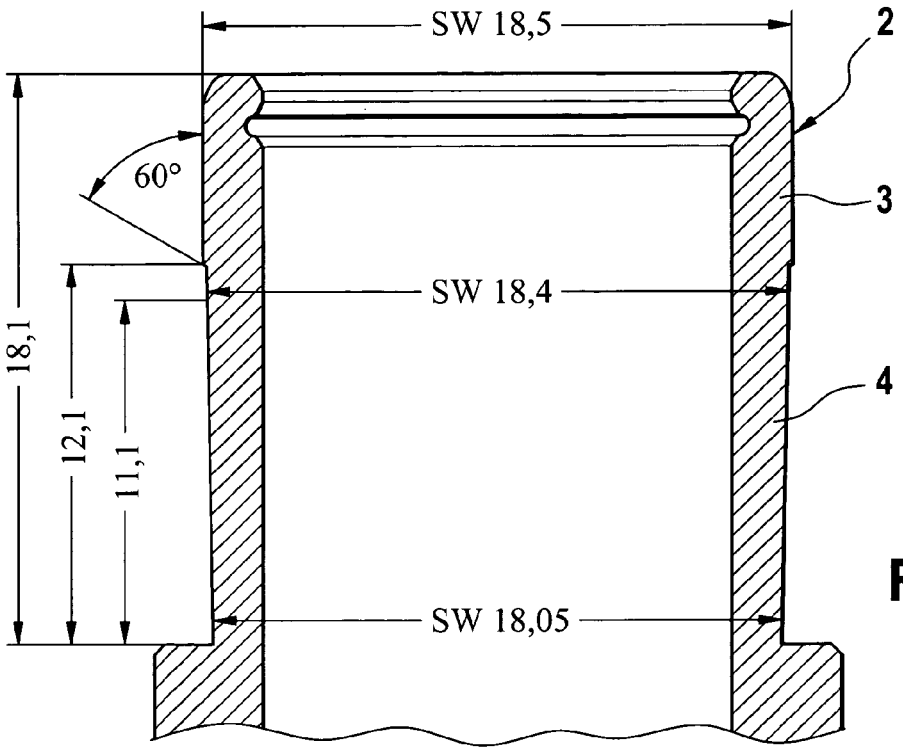
FIG. 3 is a partial section through a roller tappet similar to FIG. 1.
Figure 4:
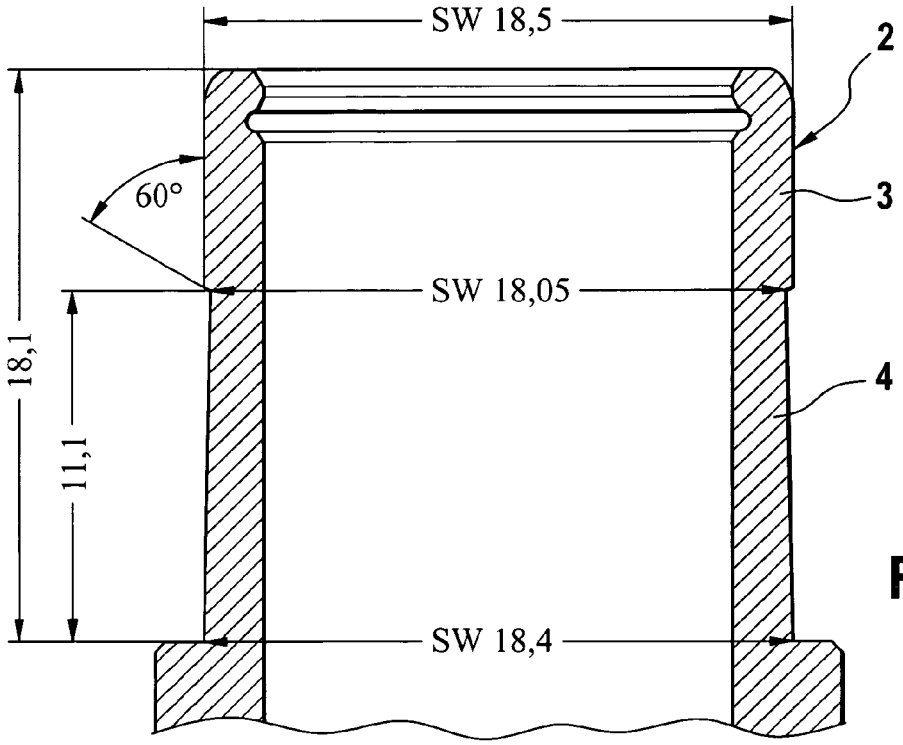
FIG. 4 shows a partial section similar to FIG. 2.

Different to FIG. 3, the end region 4 adjoining the roller 7 in FIG. 4 is configured so that the spacing dimension increases in the direction of the roller 7 from 18.05 mm to 18.4 mm but is still smaller than the spacing dimension in the end region 3.

Figure 5:
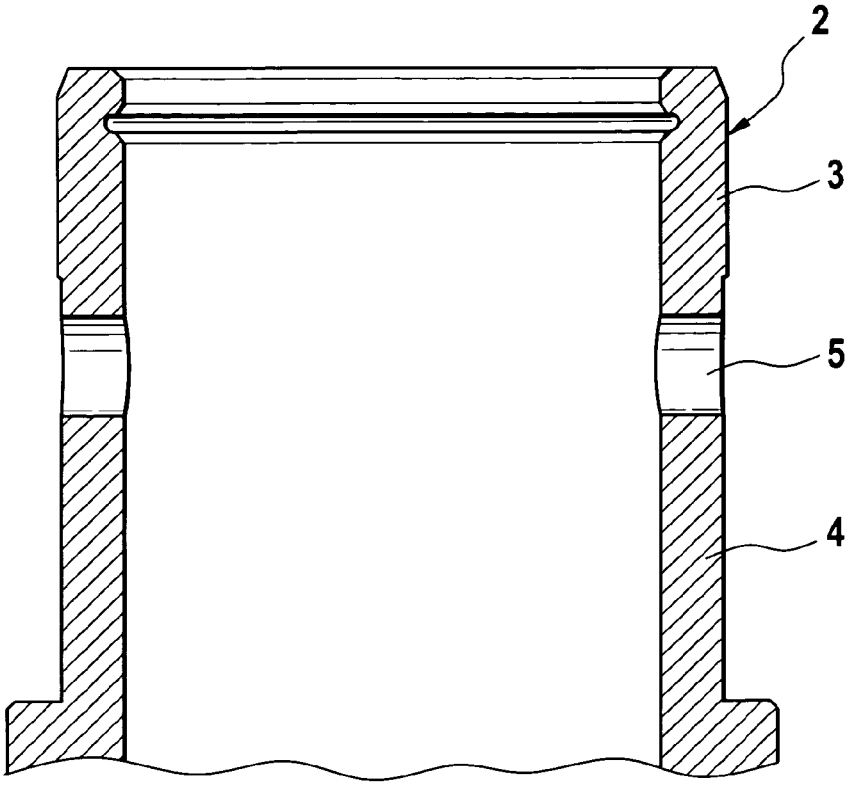
FIG. 5 is a partial section corresponding to FIGS. 1 to 4, with openings in the wall.
Figure 6:
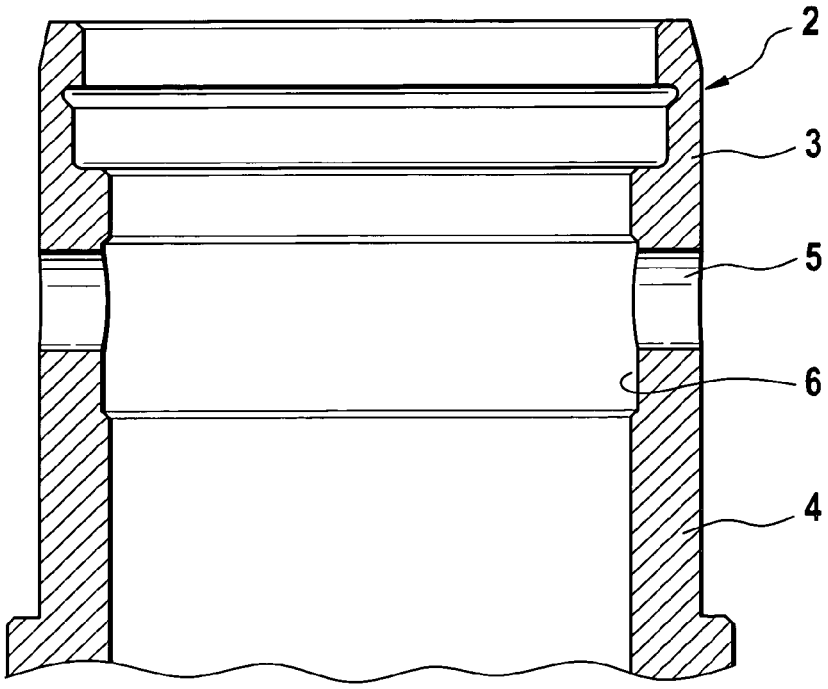
FIG. 6 is a partial section similar to FIGS. 1 to 4, with openings and annular groove.

The examples of embodiment of FIGS. 5 and 6 show that an opening 5 is arranged in each of the regions 4 that adjoin the roller 7, which openings 5, in the embodiment of FIG. 6, are connected to a circumferential groove 6. Through these measures, oil is purposefully conveyed to the contact surfaces between the flattened portions 2 and the inner surfaces 9, so that a further reduction of friction between the roller tappets 1 and the anti-rotation bridge 10 is obtained.

| List of reference numerals | |
|---|---|
| 1 | Roller tappet |
| 2 | Flattened portions |
| 3 | End regions |
| 4 | Adjacent regions |
| 5 | Openings |

-continued

| List of reference numerals | |
|---|---|
| 6 | Circumferential groove |
| 7 | Rollers |
| 8 | Guides |
| 9 | Inner surfaces |
| 10 | Anti-rotation device |

The invention claimed is:

1. An internal combustion piston engine comprising at least one cylinder, inlet and outlet channels of said cylinder head being regulated, each one, by at least one inlet and outlet valve that is loaded by a closing spring, said inlet and outlet valves being activated by roller tappets driven by cams of a camshaft and, optionally, by further transmissions elements, said roller tappets comprising at ends oriented away from rollers of the roller tappets, two flattened portions that are arranged substantially parallel to each other while being operatively connected to two matching inner surfaces of an anti-rotation bridge made of plastic, and a spacing dimension of said flattened portions at least partially overlapping a distance between said inner surfaces, wherein, starting from a mounting position of the roller tappet in the anti-rotation bridge, an adjustment between the flattened portions of the roller tappets and the inner surfaces of the anti-rotation bridge is varied with a tendency to adjustment with lash in direction of an operating position of the roller tappet, wherein the flattened portions comprise respectively an end region oriented away from the roller and a region adjacent to the roller and in the end region of the roller tappet oriented away from the roller, a spacing between the flattened portions is larger than in the region adjacent the roller.

2. The internal combustion piston engine of claim 1, wherein, in a T-design, the flattened portions in the region adjacent the roller are parallel to each other.

3. The internal combustion piston engine of claim 1, wherein, in a V-design, the flattened portions in the region adjacent the roller are configured such that the spacing dimension decreases in direction of the roller.

4. The internal combustion piston engine of claim 1, wherein, in a A-design, the flattened portions in the region adjacent the roller are configured such that the spacing dimension increases in direction of the roller.

5. The internal combustion piston engine of claim 1, wherein at least one opening in a region of the flattened portions, in the region of the roller tappet adjacent the roller, said opening being loaded on an inner side by oil from the internal combustion piston engine.

6. The internal combustion piston engine of claim 5, wherein the at least one opening is arranged in the region, which is adjacent the roller, at ends adjacent the end region.

7. The internal combustion piston engine of claim 5, wherein a circumferential groove is arranged in the roller tappet, at an inner end of the at least one opening.

8. The internal combustion piston engine of claim 1, wherein the spacing dimension of the inner surfaces of the anti-rotation bridge decreases in direction of the roller.

9. The internal combustion piston engine of claim 1, wherein the spacing dimension of the inner surfaces of the anti-rotation bridge is configured in a non-continuous and/or partially continuous reciprocal relationship to the spacing dimension of the flattened portions on the roller tappet.

10. The internal combustion piston engine of claim 1, wherein oil grooves are arranged on the inner surfaces of the anti-rotation bridge.

11. The internal combustion piston engine of claim 1, wherein a hydraulic valve lash adjuster, which comprises at least one piston, a cylinder housing cooperating with the piston and the housing, and a pressure oil supply, is installed in each of the roller tappets.

12. The internal combustion piston engine of claim 11, wherein the pressure oil supply is operatively connected to the at least one opening in the region of the flattened portions adjacent the roller.

* * * * *